US009750345B2

(12) United States Patent
Karu et al.

(10) Patent No.: US 9,750,345 B2
(45) Date of Patent: Sep. 5, 2017

(54) DRAWER WALL ELEMENT

(71) Applicant: Grass GMBH, Hoechst (AT)

(72) Inventors: Felix Karu, Altach (AT); Juergen Nachbaur, Hohenems (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/185,631

(22) Filed: Jun. 17, 2016

(65) Prior Publication Data

US 2016/0316909 A1 Nov. 3, 2016

Related U.S. Application Data

(63) Continuation of application No. PCT/EP2014/077504, filed on Dec. 12, 2014.

(30) Foreign Application Priority Data

Dec. 20, 2013 (DE) ..... 20 2013 011 426 U

(51) Int. Cl.
*A47B 88/00* (2017.01)
*A47B 88/90* (2017.01)
*A47B 88/913* (2017.01)

(52) U.S. Cl.
CPC ..... *A47B 88/0014* (2013.01); *A47B 88/941* (2017.01); *A47B 88/913* (2017.01)

(58) Field of Classification Search
CPC ..... Y10T 403/39; Y10T 403/3906; Y10T 403/3913; Y10T 403/4602;
(Continued)

(56) References Cited

U.S. PATENT DOCUMENTS 556,183 A * 3/1896 Haberthur ..... B61L 29/026 200/86 R
4,162,114 A * 7/1979 Litchfield ..... A47B 88/487 312/334.1
(Continued)

FOREIGN PATENT DOCUMENTS

DE 297 09 362 U1 8/1997
DE 10 2008 024 673 A1 11/2009
(Continued)

OTHER PUBLICATIONS

International Search Report (With English Translation) and Written Opinion, International Application No. PCT/EP2014/077504, dated Mar. 18, 2015 (10 pages).
(Continued)

*Primary Examiner* — Janet M Wilkens
(74) *Attorney, Agent, or Firm* — Burr & Brown, PLLC

(57) ABSTRACT

A drawer wall element for a drawer. An edge portion of a drawer base can be installed thereon, forming a drawer side wall. The drawer wall element comprises a profiled wall part and a profiled base-receiving part. A support surface is present on the profiled base-receiving part. The profiled wall part comprises a chamber portion having inner and outer wall sheet metal portions, spaced from one another in an opposing manner across a width of the drawer wall element and connected by a bent section. A bearing portion is angled upwards towards the support surface. A web portion is provided on the profiled base-receiving part above and spaced from the support surface. At least one freely resilient tab protrudes past the support surface or the side of the web portion facing the support surface.

15 Claims, 3 Drawing Sheets

(58) Field of Classification Search
CPC ..... Y10T 403/4605; Y10T 403/4642; A47B 88/0055; A47B 88/0422; A47B 88/0433; A47B 88/0437; A47B 88/90; A47B 88/941; A47B 88/951; A47B 88/952; A47B 2088/0074; A47B 2088/901; A47B 2210/09; A47B 2210/0054; A47B 2210/0056
USPC ..... 403/DIG. 12, DIG. 13, 331, 322.4, 325, 403/326; 312/330.1, 334.4, 334.5, 334.6, 312/348.1, 348.2, 348.4, 257.1, 263, 312/265.5; 384/22
See application file for complete search history.

(56) References Cited

U.S. PATENT DOCUMENTS 4,458,964 A * 7/1984 Hardy ..... A47B 88/487 312/333
5,147,123 A * 9/1992 Berger ..... A47B 88/941 312/348.1
5,180,217 A * 1/1993 Lautenschlager .... A47B 88/941 312/330.1
5,462,349 A * 10/1995 Grabher ..... A47B 88/941 312/330.1
5,494,348 A * 2/1996 Grabher ..... A47B 88/941 312/263
5,709,444 A * 1/1998 Fitz ..... A47B 88/427 312/330.1
5,971,516 A * 10/1999 Huber ..... A47B 88/941 312/265.5
5,992,958 A * 11/1999 Scheible ..... A47B 88/941 312/330.1
6,053,592 A * 4/2000 Sutterlutti ..... A47B 88/941 312/330.1
6,095,627 A * 8/2000 Sutterlutti ..... A47B 88/427 312/263
6,474,761 B1 * 11/2002 Muterthies ..... A47B 88/427 312/330.1
7,455,374 B2 * 11/2008 Nachbaur ..... A47B 88/467 312/330.1

FOREIGN PATENT DOCUMENTS

DE 20 2009 005 203 U1 3/2010
DE 10 2010 036 706 A1 2/2012
DE 10 2011 054 023 A1 3/2013
EP 0 722 680 A2 7/1996

OTHER PUBLICATIONS

German Search Report, German Application No. 20 2013 011 426.6, dated Dec. 1, 2014 (5 pages).
International Preliminary Report on Patentability (PCT/EP2014/077504) dated Jun. 30, 2016.

* cited by examiner

DRAWER WALL ELEMENT

CROSS REFERENCE TO RELATED APPLICATIONS

This application is a continuation of International Application No. PCT/EP2014/077504 filed Dec. 12, 2014, which designated the United States, and claims the benefit under 35 USC §119(a)-(d) of German Application No. 20 2013 011 426.6 filed Dec. 20, 2013, the entireties of which are incorporated herein by reference.

FIELD OF THE INVENTION

The present invention relates to a drawer wall element and to a piece of furniture.

BACKGROUND OF THE INVENTION

A very wide range of different embodiments of drawer wall elements are known in the field of furniture making. Here, a drawer wall element made of metal is used particularly for furniture for which an increased load-bearing capability is anticipated. Here, the wall element can be brought into a comparatively robust form for example from a metal sheet by punching and bending. In comparison to the processing of other materials, a metal drawer wall element can be produced with relatively high precision.

SUMMARY OF THE INVENTION

The object of the present invention is to provide a drawer wall element for the economical and qualitatively stable production of drawers.

The starting point of the present invention lies in a drawer wall element for a drawer, on which an edge portion of a drawer base can be installed in order to form a drawer side wall adjoining the drawer base. Here, the drawer wall element comprises a profiled wall part and a profiled base-receiving part, wherein a support surface which is present on the profiled base-receiving part is provided on the drawer wall element in order to support the underside of a drawer base which can be installed on the drawer wall element, and wherein the profiled wall part comprises a chamber portion having an inner wall sheet metal portion and an outer wall sheet metal portion, which are distanced from one another in an opposing manner across a width dimension of the drawer wall element and are connected by a bent section.

The core of the present invention lies in that a bearing portion is provided which is angled upwards towards the support surface, and in that a web portion is provided on the profiled base-receiving part above and at a distance from the support surface, the web portion adjoining the bearing portion by means of a bent material section, wherein at least one freely resilient tab which protrudes past the surface of the support surface or the side of the web portion facing the support surface is provided in the support surface and/or in the web portion.

The edge portion of the drawer base is engaged here on opposite sides with the support surface and the web portion, between which the edge portion of the drawer base can be clamped. The support surface and the web portion are arranged for this purpose in a manner largely overlapping one another in a direction perpendicular to the support surface. The profiled base-receiving part can extend over an entire length of the drawer wall element in the longitudinal direction thereof or over part of the entire length. When a profiled base-receiving part extends only over part of the length of the drawer wall element, the drawer wall element can have a plurality of profiled base-receiving parts, for example two or three.

Due to the freely resilient tab, which is raised from the support surface or the web portion, a pressing force can be ensured when a thickness of the drawer base varies, for example as a result of deviations during production. A raised arrangement of the freely resilient tab is intended here to mean that an upper side of the tab on the support surface protrudes past the support surface and that, in the event that the tab is formed on the web portion, the underside of the tab protrudes downwards from a web bearing surface of the web portion. As a result of a distance between a raised surface of the tab and a surrounding surface provided by the support surface or the web portion, the profiled base-receiving part can be advantageously adapted for example to deviations of a thickness of a drawer base and for example to a desired clamping force for holding the drawer base.

This provides the advantage that the profiled base-receiving part can hold an edge portion of the drawer base on opposite sides thereof. Here, the profiled base-receiving part can be advantageously adapted with the aid of the raised and freely resilient tab to a varying thickness of drawer bases, which variations can occur for example due to production.

The bearing portion can be provided as a stop in the event of installation, for example by pressing the profiled base-receiving part against the edge portion of the drawer base. The tab can thus be positioned at a safe distance from a side edge of the drawer base in order to prevent the drawer base from springing out, for example immediately following insertion of the drawer base into the profiled base-receiving part.

The web portion preferably bridges a distance, for example the width dimension, between the outer wall sheet metal portion and the inner wall sheet metal portion. Here, the chamber portion can be at least partially closed by the web portion, for example on an underside of the chamber portion. Here, a greater base surface can be provided in the storage space.

A preferred embodiment lies in the fact that the bearing portion bears against the outer wall sheet metal portion. Additional support and rigidity can thus be provided in the region in which the outer wall sheet metal portion bears against the bearing portion. Where appropriate, the profiled base-receiving part and the profiled wall part are fastened to one another in the region of the bearing portion, for example by means of a welded joint and/or for example a riveted joint, for example in order to increase the stability of the drawer wall element. Here, an offset, in particular a step-like offset, can be formed on the bearing portion, by means of which the bearing portion can be supported on a stepped profiled portion on the outer wall sheet metal part.

The bearing portion is preferably flat, whereby a narrow side of the drawer base can bear flush against the bearing portion.

For economical production, the tab is preferably freely punched from the material of the profiled base-receiving part. In addition, a tab can be attached for example by riveting and for example by welding to the profiled base-receiving part.

A bent section can be formed on the tab, by means of which bent section the tab is pressed against an adjacent drawer base. An elasticity can thus be adapted to a variation of the thickness of the drawer base. Here, it is particularly preferable when the tab has an S-shaped bent section between a connection to the profiled base-receiving part and a freely protruding end. The tab can thus bear flat against the drawer base.

It is additionally preferable for the tab to have an eyelet at a freely protruding end in order to pass through a fastening element. A drawer base can thus advantageously be prevented from shifting parallel to a support surface.

The eyelets on the tab can be formed as a slot, for example so as to be able to compensate for tolerances in the position of a mounting hole on the drawer base.

In addition, it is preferable for the tab to be connected to a portion of the profiled base-receiving part disposed perpendicularly to the support surface, in particular is connected continuously to the bearing portion. It is thus possible advantageously to prevent the base-receiving portion from being pushed away from the underside of the drawer base.

A counter holding element can be formed on the profiled base-receiving part, which counter holding element is arranged on a surface opposite the tab and protruding in the direction of the tab.

The profiled base-receiving part can be hidden by the outer wall sheet metal portion of the profiled wall part, at least from the support surface and above the support surface.

It is also preferable for the web portion to be supported on the inner wall sheet metal portion.

BRIEF DESCRIPTION OF THE DRAWINGS

The present invention will be explained hereinafter on the basis of an exemplary embodiment and with the aid of drawings, which are not to scale. The reference signs are used consistently in all Figs. for the same features. In the Figs..

DETAILED DESCRIPTION OF THE INVENTION

Figure 1:
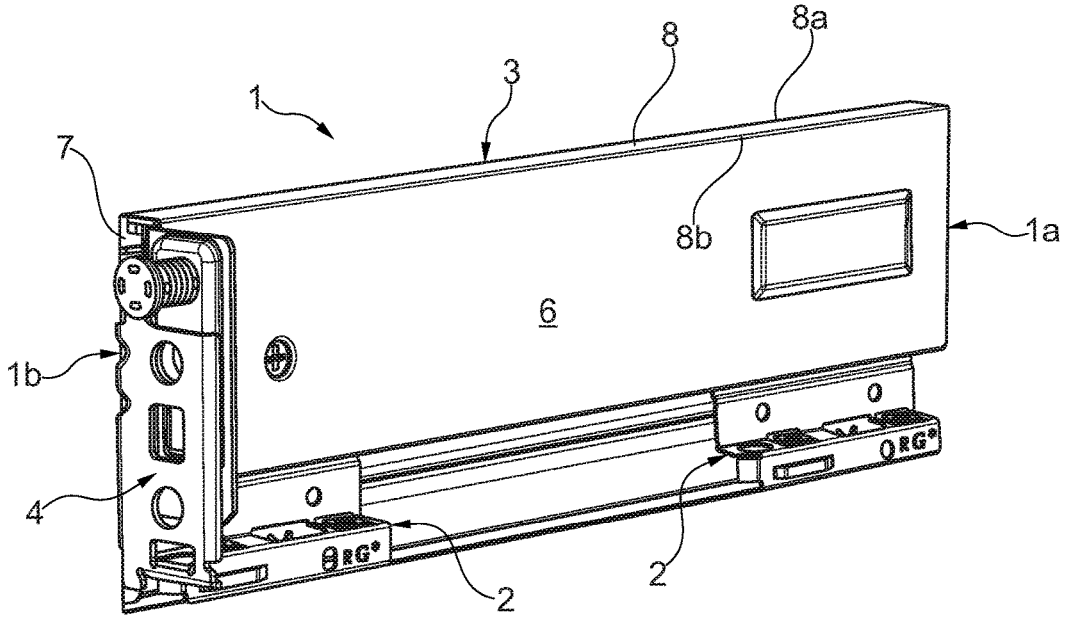
FIG. 1 shows a schematic perspective view of a drawer wall element according to the present invention.

FIG. 1 shows an exemplary embodiment of a drawer wall element 1 according to the present invention. The drawer wall element 1 comprises a profiled wall part 3 and two profiled base-receiving parts 2, wherein one of the profiled base-receiving parts 2 is arranged on a front-side end face 1*a* and one of the profiled base-receiving parts 2 is arranged on a rear-side end face 1*b* of the drawer wall element 1. A rear-wall connector 4 can also be mounted on the rear-side end face 1*b* of the drawer wall element 1.

The profiled wall part 3 comprises an inner wall sheet metal portion 6, an upper side sheet metal portion 8, and an outer wall sheet metal portion 7. The inner wall sheet metal portion 6 and the outer wall sheet metal portion 7 are interconnected via the upper side sheet metal portion 8. Here, the upper side sheet metal portion 8 is connected to the outer wall sheet metal portion 7 by a bending edge 8*a* and to the inner wall sheet metal portion 6 by a bending edge 8*b*, whereby a connecting bent section is provided. The sheet metal portions 6, 7 and 8 are preferably produced from an individual continuous sheet metal part and are continuously interconnected.

Figure 2:
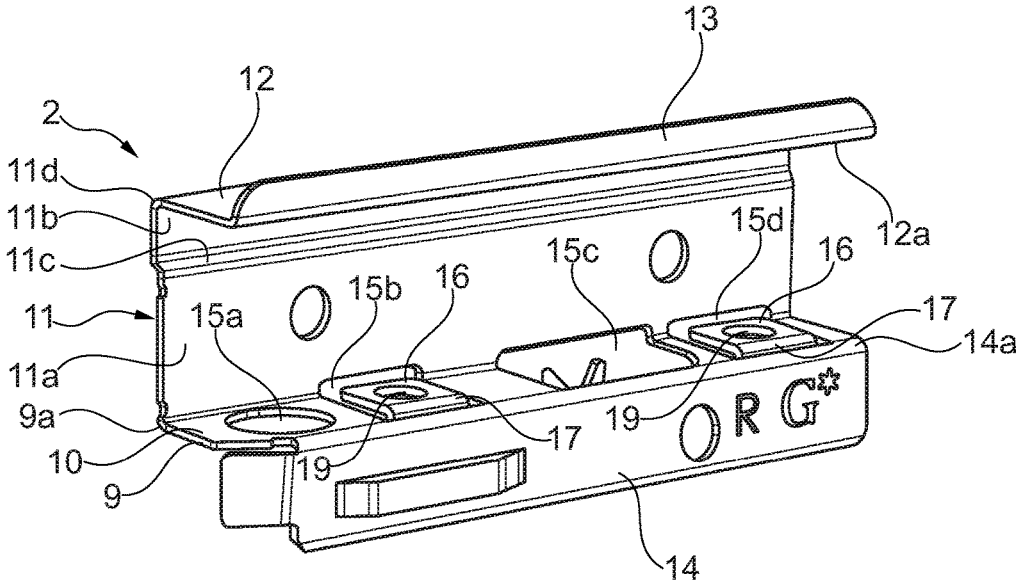
FIG. 2 shows a schematic perspective view of a profiled base-receiving part.
Figure 3:
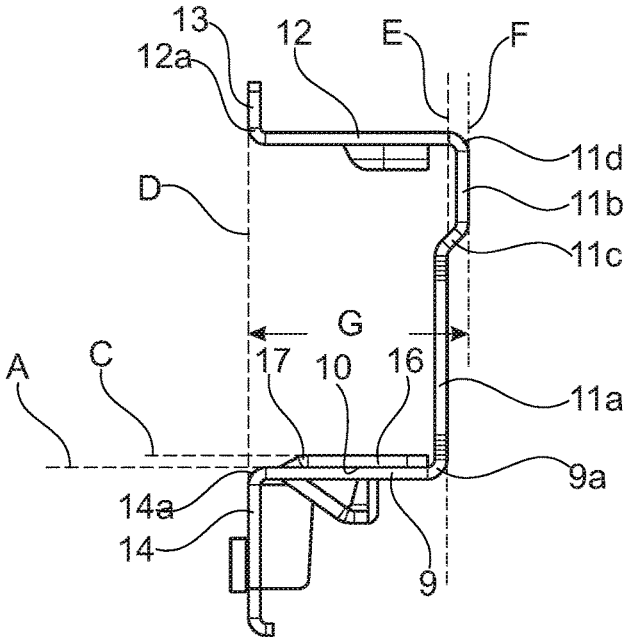
FIG. 3 shows a schematic side view of an end face of the profiled base-receiving part.
Figure 4:
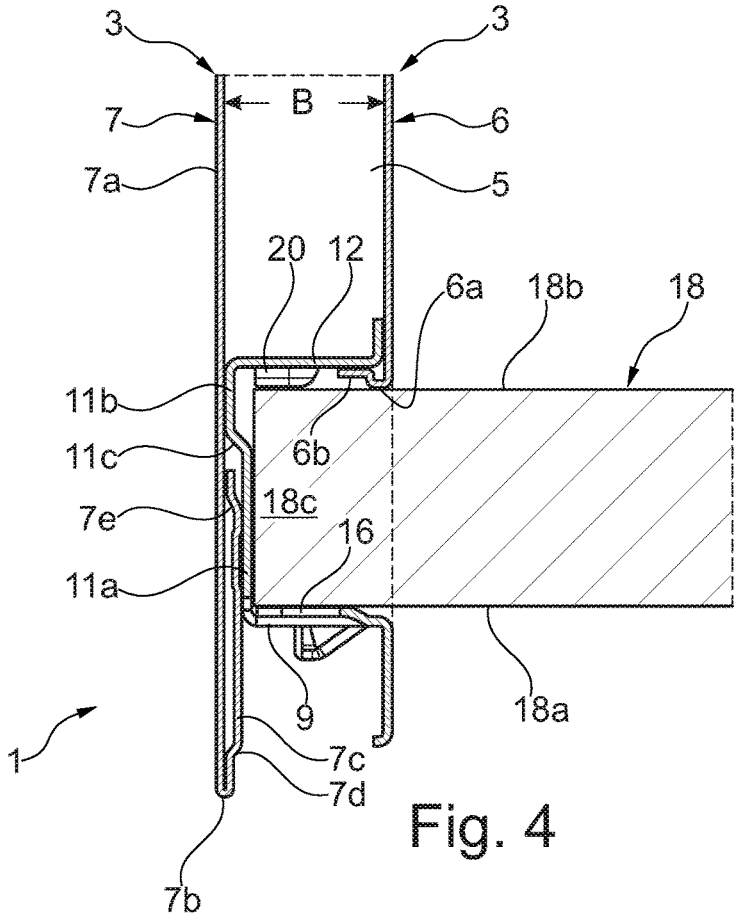
FIG. 4 shows a schematic view of an end face parallel along a longitudinal axis of the drawer wall element in a sectional illustration.

An individual profiled base-receiving part 2 is illustrated in FIGS. 2 and 3 with further details. The profiled base-receiving part 2 has a support portion 9, which is preferably intended to be arranged substantially horizontally, having a support surface 10, which is intended to support an underside 18*a* of a drawer base 18—as shown in FIG. 4. A lower profiled portion 14 is bent from the support portion 9, for example at right angles, by a bending edge 14*a*. A bending edge 9*a* connects the support portion 9 to a bearing portion 11.

The bearing portion 11 is divided by an offset portion 11*c* into a lower bearing portion 11*a* and into an upper bearing portion 11*b*. Here, the lower bearing portion 11*a* protrudes upwards in a first plane E. The upper portion 11*b* is arranged protruding upwardly, parallel to a second plane F. The offset portion 11*c* is bent in an S-shape and is arranged in a connecting manner between the lower and the upper bearing portion 11*a* and 11*b*. The bearing portion 11 is thus adapted to a cross-sectional profile of the outer wall sheet metal part 7.

The upper bearing portion 11*b* is delimited by a bending edge 11*d*, which preferably extends parallel to the bending edge 9*a*. As a result of the bending edge 11*d*, a web portion 12 can protrude from the upper bearing portion 11*b*, for example at right angles, in such a way that the web portion 12 is arranged above the support portion 9 and in particular parallel to the support portion 9. On a side of the web portion 12 opposite the bending edge 11*d*, a further bending edge 12*a* can be formed, at which a profiled portion 13 is bent in a manner protruding upwardly, in particular at right angles. Inclusive of the bending edges 11*d* and 12*a*, the web portion 12 can extend in a width dimension G, which coincides with a width dimension B of a chamber portion 5 in the drawer wall element 1. The width dimension B can be predefined for example by the profiled wall part 3, in particular by the upper side sheet metal portion 8 having the bending edges 8*a* and 8*b*.

The support surface 10 is interrupted by a plurality of openings 15*a*-15*d*, at which the sheet metal material of the support portion 9 is interrupted. Here, a largely flat tab 16 provided in the form of a strip is freely punched at each of the openings 15*b* and 15*d* and is connected to the rest of the profiled base-receiving part via an S-shaped bent section. In the embodiment shown here both tabs are formed in the same way, wherein a plurality of tabs can also be formed differently in other embodiments not shown.

The S-shaped bent section 17 is formed uniformly in the exemplary embodiment as a connection of the tab 16 to the bending edge 14*a* parallel thereto. At least an upper side of the tab 16 facing the web portion 12 is raised here above the support surface 10. Here, the tab 16 is connected only indirectly to the support surface 10 via the bending edge 14*a*. With an attached drawer base 18, as shown in FIG. 4, deformations of the support portion 9 and of the S-shaped bent section 17 caused in the event of clamping of the drawer base can cooperate in such a way that the tab 16 advantageously bears flat against an underside 18*a* of the drawer base 18. Here, in particular, an inclination of the tab 16 relative to the support portion 9 and, where appropriate, inclinations of the tab 16 and of the support portion 9 with respect to the web portion 12 can be coordinated with one another in such a way that the tab 16 always bears flat, in particular parallel to the underside 18*a* of the drawer base 18, against different drawer bases 18 having different base thicknesses, within a predefined tolerance. A plane C of the upper side of the tab 16 and a plane A of the support surface 10 can therefore be inclined relative to one another. By way of example, without a clamped drawer base, the plane A can be arranged in a manner ascending from the bending edge 9*a* and the plane C can also ascend comparatively slightly from the bent section 17. It is thus advantageously ensured that an edge portion 18*c* of a drawer base 18 is always in frictional contact with the drawer wall element at increased pressure, at least in the region of the tabs 16.

An eyelet 19 is for example punched out on the tab 16 and is intended for a fastening of the drawer base 18 to the profiled base-receiving part 2, for example using a screw. Once the drawer base 18 has been installed between the web portion 12 and the support portion 9, the drawer base 18 can be prevented from shifting or slipping out from the profiled base-receiving part 2, for example by being screwed in place.

Figure 5:
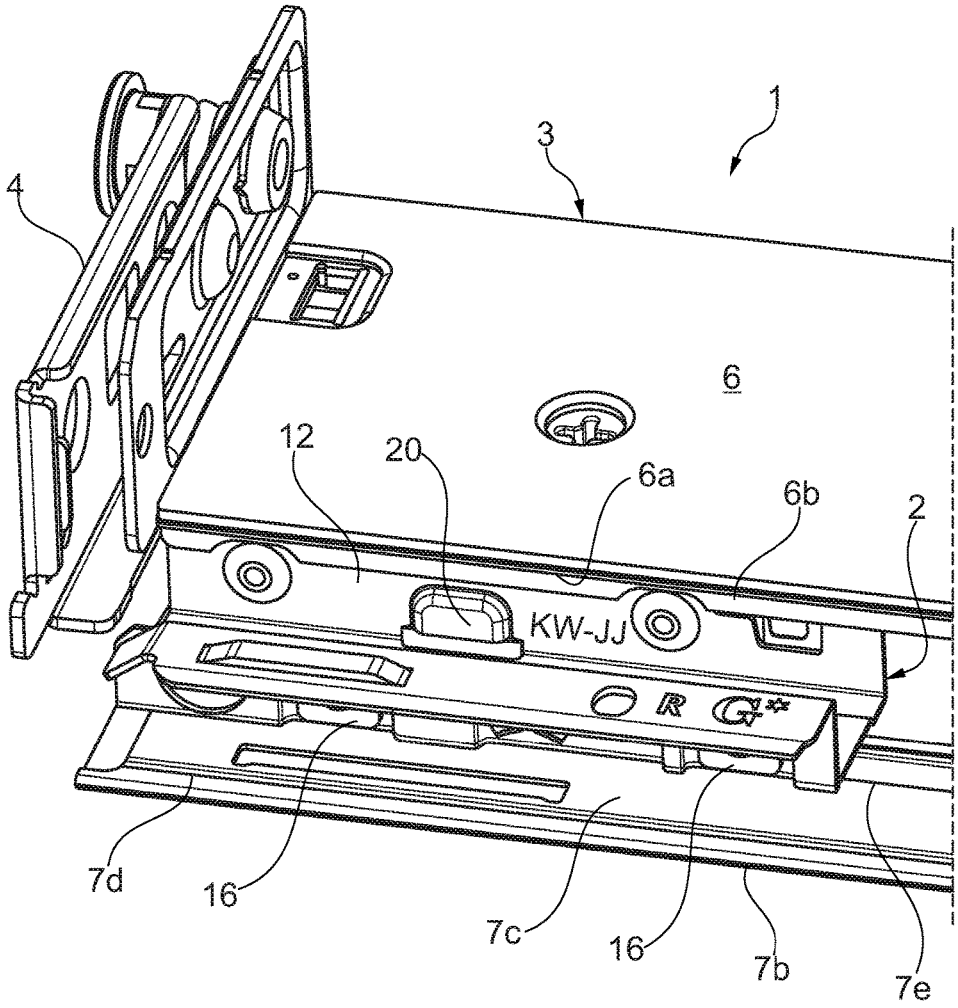
FIG. 5 shows a schematic perspective view of a detail of the drawer wall element.

A protrusion 20 is formed on the web portion 12 and projects from an underside of the web portion 12 in the direction of the support surface 10. The protrusion 20 is arranged closer to the bending edge 11*d* than to the bending edge 12*a*. It can be seen in FIG. 5 that the protrusion 20 extends over a comparatively small portion of a longitudinal axis of the profiled base-receiving part 2.

FIG. 4 shows an arrangement of the profiled wall part 3 and the profiled base-receiving part 2 on the drawer wall element 1 with the inserted drawer base 18. The inner wall sheet metal part 6 is delimited downwardly by a U-shaped bending edge 6*a*, at which the inner wall sheet metal part 6 is bent inwardly. As a result of a further bending, a flat portion 6*b* is arranged horizontally inwardly in the direction of the outer wall sheet metal part 7. Here, the portion 6*b* is raised approximately by a bending radius of the U-shaped bending edge 6*a* compared with a lower edge of the inner wall sheet metal portion 6 at the bending edge 6*a*.

The outer wall sheet metal part 7 protrudes via an outer portion 7*a* downwardly past the inner wall sheet metal part 6. Here, a folding edge 7*b*, against which a folding portion 7*c* of the outer wall sheet metal part 7 is driven so as to also bear in part against the portion 7*a*, forms a lower edge of the outer wall sheet metal part 7. As a result of S-shaped bent sections 7*d* and 7*e*, the folding portion 7*c* is distanced in part from the portion 7*a* in a plane parallel to the latter.

The profiled base-receiving part 2 is hung, so to speak, via the profiled portion 13 and the web portion 12 in the profiled wall part, wherein the web portion 12 and the profiled part 13 bear against a surface of the inner wall sheet metal portion 6 facing the chamber portion 5. Here, the web portion 12 lies on the horizontal portion 6*b*. The lower edge of the inner wall sheet metal part 6 at the U-shaped bent section 6*a* can thus press with the protrusion 20 on the web portion 12 against an upper side 18*b* of the drawer base 18. On account of the protrusion 20, the U-shaped bent section 6*a* and the tab 16, the drawer base 18 is fixed or held in position. The profiled portion 13 and the upper bearing portion 11*b* are held at a distance by means of the web portion 12, as a result of which the bearing sheet metal parts 6 and 7 are arranged in a parallel position to one another, at least from the upper side 18*b* of the drawer base 18 to the upper side sheet metal portion 8.

Below the offset portion 11*c*, the lower bearing portion 11*a* bears against the folding portion 7*c*. Here, the profiled base-receiving part can be fixed to the folding portion, for example by a welded joint or also for example by a riveted joint (not shown), wherein the fixing to the outer portion 7*a* would not be visible. The lower bearing portion 11*a* additionally forms a stop when the edge portion 18*c* of the drawer base 18 is inserted, whereby the edge region 18*c* projects over a majority of the width dimension B into the drawer wall element 1 and in so doing can stabilize the drawer wall element 1.

LIST OF REFERENCE SIGNS

1 drawer wall element
1*a* front-side end face
1*b* rear-side end face
2 profiled base-receiving part
3 profiled wall part
4 rear-wall connector
5 chamber portion
6 inner wall sheet metal portion
6*a* bending edge
6*b* portion
7 outer wall sheet metal portion
7*a* outer portion
7*b* folding edge
7*c* folding portion
7*d* S-bent section
7*e* S-bent section
8 upper side sheet metal portion
8*a* bending edge
8*b* bending edge
9 support portion
9*a* bending edge
10 support surface
11 bearing portion
11*a* lower bearing portion
11*b* upper bearing portion
11*c* offset portion
11*d* bending edge
12 web portion
12*a* bending edge
13 profiled portion
14 profiled portion
14*a* bending edge
15*a* opening
15*b* opening
15*c* opening
15*d* opening
16 tab
17 bent section
18 drawer base
18*a* underside
18*b* upper side
18*c* edge region
19 eyelet
20 protrusion

The invention claimed is:

1. A drawer wall element for a drawer, on which an edge portion of a drawer base can be installed in order to form a drawer side wall adjoining the drawer base, wherein the drawer wall element comprises a profiled wall part and a profiled base-receiving part, wherein a support surface which is present on the profiled base-receiving part is provided on the drawer wall element in order to support the underside of the drawer base which can be installed on the drawer wall element, and wherein the profiled wall part comprises a chamber portion having an inner wall sheet metal portion and an outer wall sheet metal portion, which are distanced from one another in an opposing manner across a width dimension of the drawer wall element and are connected by a bent section, wherein a bearing portion is provided which is angled upwards towards the support surface, and wherein a web portion is provided on the profiled base-receiving part to face the support surface above and at a distance from the support surface, the web portion adjoining the bearing portion by means of a bent material section, and wherein at least one freely resilient tab which protrudes past the surface of the support surface or the side of the web portion facing the support surface is provided in at least one of the support surface and in the web portion.

2. The drawer wall element as claimed in claim 1, wherein the web portion bridges a distance between the outer wall sheet metal portion and the inner wall sheet metal portion.

3. The drawer wall element as claimed in claim 1, wherein the bearing portion bears against the outer wall sheet metal portion.

4. The drawer wall element as claimed in claim 1, wherein the bearing portion is flat.

5. The drawer wall element as claimed in claim 1, wherein the tab is freely punched from the material of the profiled base-receiving part.

6. The drawer wall element as claimed in claim 1, further comprising a bent section formed on the tab, by means of which bent section the tab is pressed against an adjacent drawer base.

7. The drawer wall element as claimed in claim 1, wherein the tab has a bent section between a connection to the profiled base-receiving part and a freely protruding end.

8. The drawer wall element as claimed in claim 1, wherein the tab has an eyelet at a freely protruding end for passing through a fastening element.

9. The drawer wall element as claimed in claim 8, wherein the eyelet on the tab is formed as a slot.

10. The drawer wall element as claimed in claim 1, wherein the tab is continuously connected to a portion of the profiled base-receiving part disposed perpendicularly to the support surface.

11. The drawer wall element as claimed in claim 10, wherein the tab is connected continuously to the bearing portion.

12. The drawer wall element as claimed in claim 1, further comprising a counter holding element formed on the profiled base-receiving part and arranged on a surface opposite the tab and protruding in the direction of the tab.

13. The drawer wall element as claimed in claim 1, wherein the profiled base-receiving part is hidden by the outer wall sheet metal portion of the profiled wall part at least from the support surface and from above.

14. The drawer wall element as claimed in claim 1, wherein the web portion is supported on the inner wall sheet metal portion.

15. A piece of furniture comprising a drawer wall element as claimed in claim 1.

* * * * *